US010494167B2

(12) United States Patent
Kojima et al.

(10) Patent No.: US 10,494,167 B2
(45) Date of Patent: Dec. 3, 2019

(54) DISPENSER FOR AEROSOL CONTAINER

(71) Applicants: HOYU CO., LTD., Nagoya-shi, Aichi (JP); YOSHINO KOGYOSHO CO., LTD., Tokyo (JP)

(72) Inventors: Hisayuki Kojima, Nagakute (JP); Yuji Kitabayashi, Nagakute (JP); Hideo Uemura, Tokyo (JP)

(73) Assignees: HOYU CO., LTD., Nagoya (JP); YOSHINO KOGYOSHO CO., LTD., Tokyo (JP)

( * ) Notice: Subject to any disclaimer, the term of this patent is extended or adjusted under 35 U.S.C. 154(b) by 75 days.

(21) Appl. No.: 15/559,105

(22) PCT Filed: Mar. 24, 2016

(86) PCT No.: PCT/JP2016/001712
§ 371 (c)(1),
(2) Date: Sep. 18, 2017

(87) PCT Pub. No.: WO2016/157849
PCT Pub. Date: Oct. 6, 2016

(65) Prior Publication Data

US 2018/0244459 A1 Aug. 30, 2018

(30) Foreign Application Priority Data

Mar. 27, 2015 (JP) ..... 2015-065585

(51) Int. Cl.
*B65D 83/68* (2006.01)
*B05B 9/04* (2006.01)
(Continued)

(52) U.S. Cl.
CPC ..... *B65D 83/68* (2013.01); *B01F 5/0619* (2013.01); *B05B 9/04* (2013.01); *B65D 83/28* (2013.01);
(Continued)

(58) Field of Classification Search
CPC .. B01F 5/0619; B01F 2005/0637; B05B 9/04; B65D 83/28; B65D 83/68; B65D 83/682
(Continued)

(56) References Cited

U.S. PATENT DOCUMENTS 6,305,578 B1 * 10/2001 Hildebrandt ..... B01F 5/0403 222/135
6,877,924 B1 * 4/2005 Mears ..... A45D 19/02 132/113
(Continued)

FOREIGN PATENT DOCUMENTS

EP 2657151 A1 10/2013
JP 2002-326684 A 11/2002
(Continued)

OTHER PUBLICATIONS

Aug. 20, 2018 Search Report issued in European Patent Application No. 16771739.6.
(Continued)

*Primary Examiner* — Paul R Durand
*Assistant Examiner* — Andrew P Bainbridge
(74) *Attorney, Agent, or Firm* — Oliff PLC

(57) ABSTRACT

A dispenser for an aerosol container includes: a fixed platen, configured to be fitted to an aerosol container with two stems; a coupling member, provided with two coupling holes, through which contents dispensed from the two stems pass separately; a cover, which includes an inner tubular portion, configured to surround the two coupling holes and define passages for the contents, and an outer tubular portion, configured to cover the mounting cup; and an application member, which includes a dispensing port, through which the contents are dispensed from the inner tubular portion to outside. The cover includes at least one cut-out portion, formed by cutting part of the outer tubular portion,
(Continued)

and the coupling member includes at least one first tab portion, configured to be accommodated in the cut-out portion.

8 Claims, 7 Drawing Sheets

(51) Int. Cl.
*B65D 83/28* (2006.01)
*B01F 5/06* (2006.01)

(52) U.S. Cl.
CPC .... *B65D 83/682* (2013.01); *B01F 2005/0637* (2013.01)

(58) Field of Classification Search
USPC ..... 239/304, 310; 222/135–137, 222/145.5–145.6, 280, 325–327, 567, 222/402.13
See application file for complete search history.

(56) References Cited

U.S. PATENT DOCUMENTS 7,854,350 B2 * 12/2010 Lasserre ..... B65D 83/68 222/135
9,452,440 B2 * 9/2016 Taggart ..... B05B 11/0078
9,463,919 B2 * 10/2016 Eini ..... B01F 3/04446
2007/0108231 A1 * 5/2007 Gray ..... B01F 5/0603 222/135
2010/0155422 A1 * 6/2010 Shin ..... B65D 83/285 222/135
2013/0161351 A1 * 6/2013 Eini ..... B01F 3/04446 222/135
2013/0270294 A1 * 10/2013 Shibata ..... B65D 83/48 222/94
2016/0023839 A1 * 1/2016 Ogata ..... B65D 83/206 222/402.13
2017/0144824 A1 * 5/2017 Petrov ..... B65D 83/682

FOREIGN PATENT DOCUMENTS

JP 2004-331101 A 11/2004
JP 4290941 B2 7/2009
JP 2011-213400 A 10/2011
JP 2014-201330 A 10/2014
WO 2012/073361 A1 6/2012

OTHER PUBLICATIONS

Sep. 21, 2018 Office Action issued in Chinese Patent Application No. 201680018868.1.
Jun. 14, 2016 International Search Report issued in International Patent Application No. PCT/JP2016/001712.
Dec. 25, 2018 Office Action issued in Japanese Application No. 2015-065585.

* cited by examiner

DISPENSER FOR AEROSOL CONTAINER

TECHNICAL FIELD

The present disclosure relates to a dispenser used for an aerosol container by being fitted to a mounting cup of the aerosol container. The present disclosure especially relates to a dispenser used for an aerosol container that is configured to contain two types of contents separately and that includes a total of two stems though which the contents may be dispensed.

BACKGROUND

It has been common practice to use a dispenser, such as the one described in Patent Literature 1, for an aerosol container containing, for example, two-liquid hair dye or hair liquid. The dispenser described in Patent Literature 1 is configured to be fitted to a pair of aerosol containers arranged side by side, each aerosol container having a single stem. The described dispenser includes a holder (a fixed platen) configured to hold the pair of aerosol containers all together, a helical passage unit (a coupling member) that includes a helical flange portion provided on an outer circumferential surface of a rod-like portion thereof and that also includes inside thereof passages for contents, a cover body (a cover) that includes helical passage portions defined inside a tubular portion surrounding the rod-like portion and the helical flange portion, and a comb-like discharge portion (an application member) provided with hole portions through which the contents from the helical passage portions are dispensed to the outside. The coupling member is provided with a tab portion used to remove the coupling member from the cover for cleaning the inside of the tubular portion. The tab portion is positioned in the middle of a lower portion of the coupling member so that the tab portion is accommodated in space defined between the pair of aerosol containers.

CITATION LIST

Patent Literature

PTL 1: Japanese Patent No. 4290941

SUMMARY

Technical Problem

We are witnessing increased use of an aerosol container which is configured by a single container containing two types of contents separately and by a mounting cup including two stems. However, when the dispenser described in Patent Literature 1 is applied to such a container, the aforementioned tab portion interferes with the mounting cup of the aerosol container. Although the tab portion may be positioned above the mounting cup in an attempt to avoid the interference, this attempt leads to an increased size of the dispenser. Besides, since the tab portion described in Patent Literature 1 is positioned inside the cover body, the coupling member cannot be removed without having to insert a finger into the cover and hold the tab portion. Accordingly, there is still room for improvement in terms of ease of the removal.

The present disclosure is to solve the above problem, and the present disclosure is to propose a novel dispenser for an aerosol container that is configured to be fitted to an aerosol container including two stems and that facilitates the removal of the coupling member from the cover.

Solution to Problem

One of aspects of the present disclosure resides in a dispenser for an aerosol container. The dispenser includes: a fixed platen configured to be fitted to a mounting cup of an aerosol container including two stems; a coupling member provided with two coupling holes through which contents dispensed from the two stems pass separately; a cover that includes an inner tubular portion configured to surround the two coupling holes and define passages for the contents and that also includes an outer tubular portion configured to cover the mounting cup; and an application member including a dispensing port through which the contents are dispensed from the inner tubular portion to outside. The cover includes at least one cut-out portion formed by cutting part of the outer tubular portion, and the coupling member includes at least one first tab portion configured to be accommodated in the at least one cut-out portion.

In a preferred embodiment, the at least one cut-out portion comprises a pair of cut-out portions disposed to sandwich the mounting cup, and the at least one first tab portion comprises a pair of first tab portions disposed in correspondence with the pair of cut-out portions.

In another preferred embodiment, the fixed platen includes an outer circumferential wall configured to surround the at least one cut-out portion and the at least one first tab portion.

In yet another preferred embodiment, the coupling member includes: a lower member including two connecting tubes configured to be coupled to the two stems; an upper member including a rod-like portion and the two coupling holes; a hinge connecting the lower member and the upper member in an openable and closable manner, wherein the lower member includes the at least one first tab portion, and the upper member includes at least one second tab portion.

Advantageous Effects

In the present disclosure, the cover includes the outer tubular portion that is configured to cover the mounting cup and that includes the at least one cut-out portion. Furthermore, the coupling member includes the at least one first tab portion configured to be accommodated in the at least one cut-out portion. The above configurations prevent the interference to the mounting cup and do not lead to the increased size of the dispenser. Moreover, the fact that the at least one first tab portion is configured to be accommodated in the at least one cut-out portion provided in the outer tubular portion omits the need for inserting a finger into the cover during the removal of the coupling member from the cover. This facilitates the removal of the coupling member.

When the at least one cut-out portion comprises the pair of cut-out portions disposed to sandwich the mounting cup, and the at least one first tab portion comprises the pair of first tab portions disposed in correspondence with the pair of cut-out portions, the following advantageous effect is provided. That is to say, the coupling member may be held by pinching these cut-out portions by, for example, the thumb and the index finger, and accordingly, the removal of the coupling member from the cover is further facilitated.

When the fixed platen includes the outer circumferential wall configured to surround the at least one cut-out portion and the at least one first tab portion, the cut-out portion and the first tab portion are covered by the outer circumferential wall. This improves appearance and moreover, prevents unwanted contact with the first tab portion.

When the coupling member includes: the lower member including the two connecting tubes configured to be coupled to the two stems; the upper member including the rod-like portion and the two coupling holes; the hinge connecting the lower member and the upper member in an openable and closable manner, wherein the lower member includes the at least one first tab portion, and the upper member includes the at least one second tab portion, the following advantageous effect is provided. That is to say, the at least one first tab portion may be grasped by fingers of one hand, and the at least one second tab portion may be grasped by fingers of the other hand, for cleaning the inside of the coupling member. Thus, the coupling member becomes easier to open.

BRIEF DESCRIPTION OF THE DRAWINGS

In the accompanying drawings:

FIG. 4A is a bottom view, and FIG. 4B is a sectional view taken along A-A in FIG. 4A;

DETAILED DESCRIPTION

A dispenser for an aerosol container according to the present disclosure will be described more concretely with respect to the drawings. Note that in the specification, the claims, and the abstract herein, the side on which a dispenser for an aerosol container is positioned with respect to an aerosol container is defined as upper direction, and the opposite side is defined as lower direction.

Figure 1:
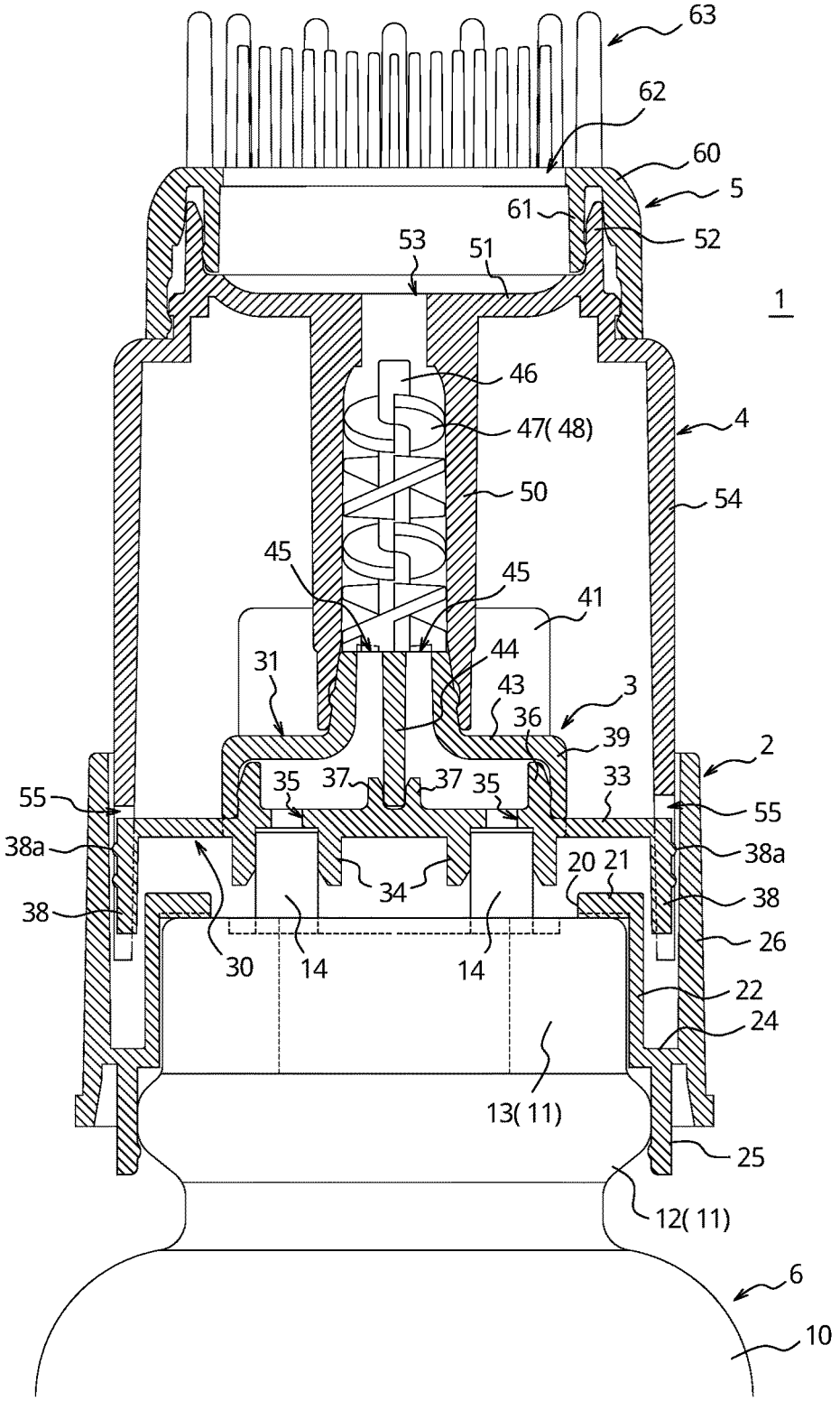
FIG. 1 is a front sectional view of a dispenser for an aerosol container in the state in which the dispenser is fitted to an aerosol container according to one of embodiments of the present disclosure.
Figure 2:
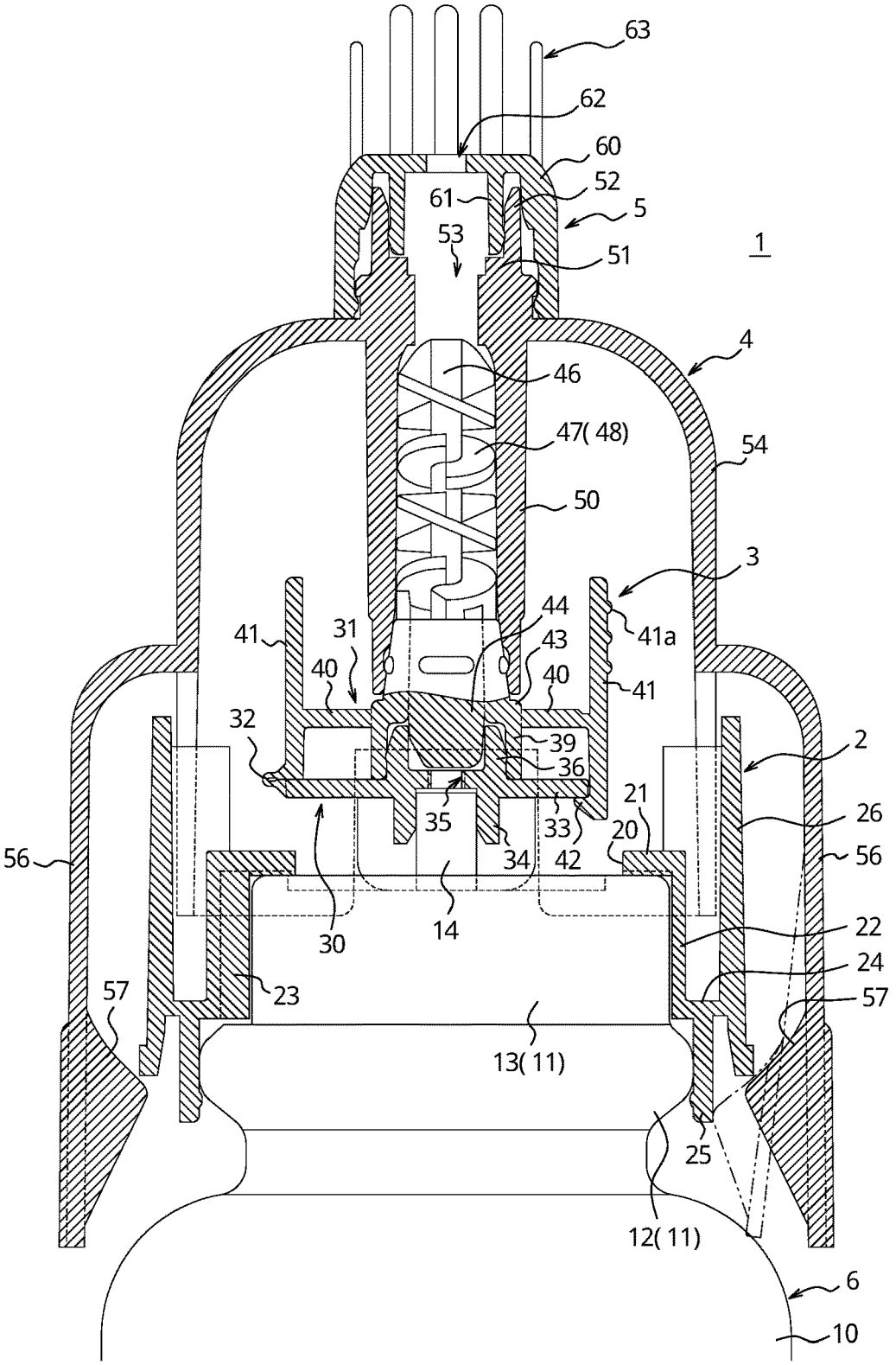
FIG. 2 is a side sectional view of a dispenser for an aerosol container as illustrated in FIG. 1.
Figure 3:
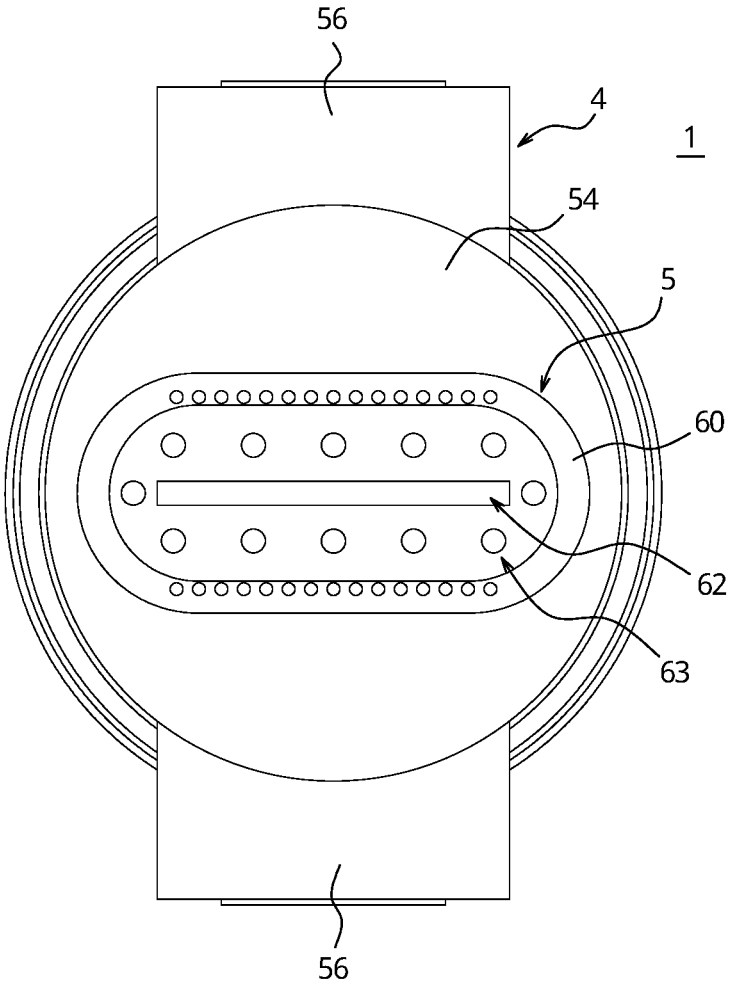
FIG. 3 is a plan view of a dispenser for an aerosol container as illustrated in FIG. 1.

In FIGS. 1 to 3, reference numeral 1 denotes a dispenser for an aerosol container (that is hereinafter called "dispenser") according to one of embodiments of the present disclosure. The dispenser 1 includes a fixed platen 2, a coupling member 3, a cover 4, and an application member 5. Reference numeral 6 denotes an aerosol container to which the dispenser 1 is fitted.

The aerosol container 6 is configured by a bottomed tubular container main body 10, which may be made of synthetic resin, and a mounting cup 11, which may be made of metal. The mounting cup 11 has an outer edge fixed to the container main body 10 by seaming. The mounting cup 11 of the present embodiment includes an annular portion 12, which is seamed to the container main body 10, and a mounting cup's main body portion 13, which is positioned above the annular portion 12 and which has a partially flat circumferential side surface. The aerosol container 6 includes a total of two stems 14, which communicate with container space for the contents. The two stems 14 protrude upward from the mounting cup's main body portion 13.

The fixed platen 2 includes an upper wall 21, which is provided in a middle portion thereof with an opening 20. The two stems 14 are exposed through the opening 20. The fixed platen 2 also includes a cylindrical side wall 22, which surrounds the side surface of the mounting cup's main body portion 13. The side wall 22 of the present embodiment includes a rib 23 in a position corresponding to the flat part of the side surface of the mounting cup's main body portion 13 (refer to FIG. 2). The rib 23 prevents rotation with respect to the mounting cup's main body portion 13. The side wall 22 is provided, in a lower end thereof, with a flange 24, which extends to the outer side in the radial direction. The flange 24 is provided, in a lower portion thereof, with a fitting wall 25, which surrounds the annular portion 12 and which is held to the annular portion 12 so as not to slip out. The side wall 22 also includes, in an outer end of the flange 24, an circumferential outer circumferential wall 26, which extends vertically with respect to the flange 24.

Figure 4A:
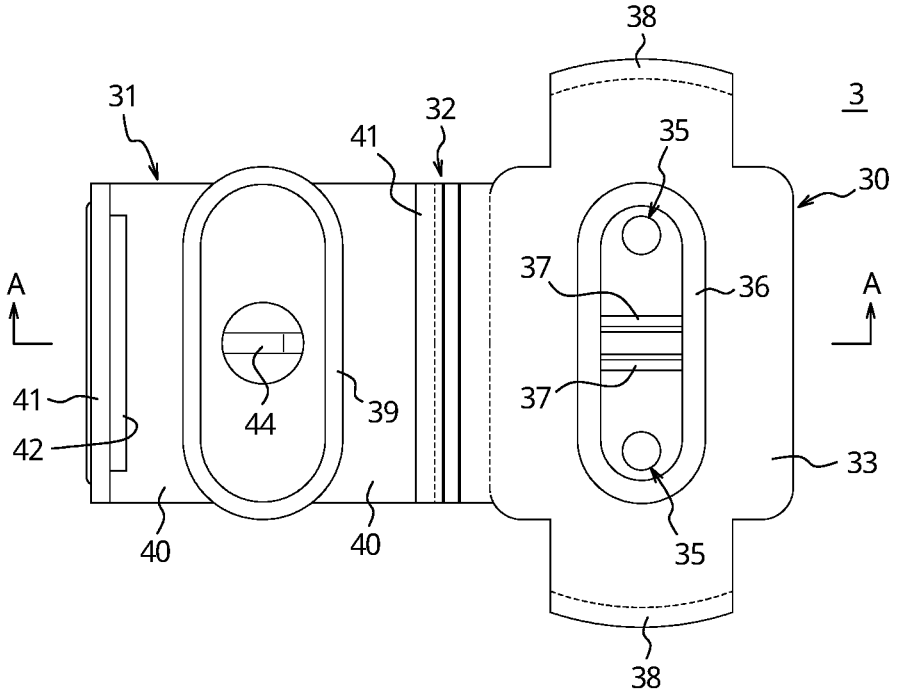
FIGS. 4A and 4B illustrate a coupling member in an opened state.
Figure 4B:
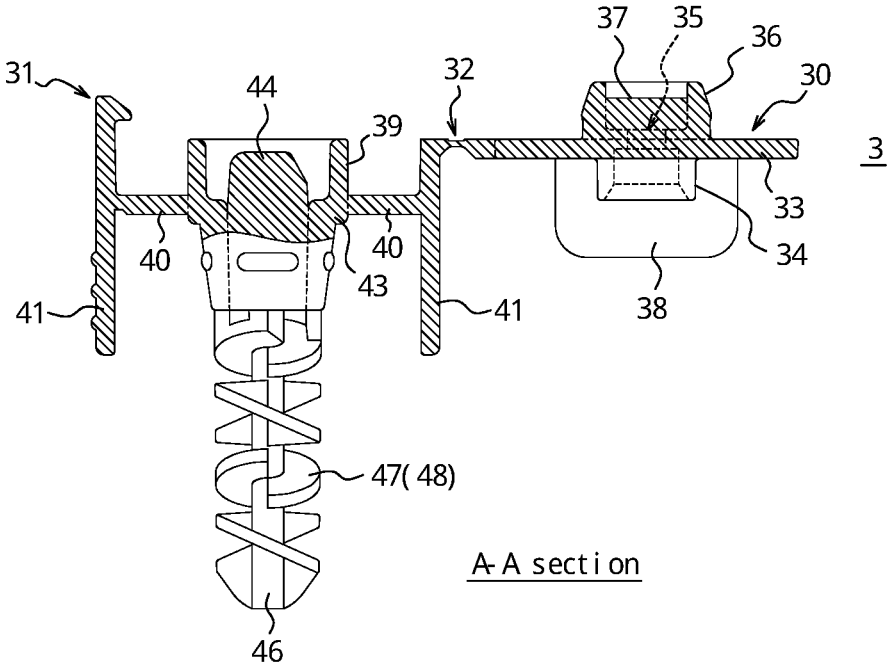

As illustrated in FIGS. 4A and 4B (which illustrate an opened state of the coupling member 3), the coupling member 3 is configured by a lower member 30 and an upper member 31, which are integrally coupled via a thin hinge 32. The coupling member 3 may be folded via the hinge 32 into a closed state illustrated in FIGS. 1 and 2.

The lower member 30 includes a lower member's main body 33, which has a flat plate shape. The lower member's main body 33 is provided, on the lower side thereof, with two connecting tubes 34, which are coupled to the two stems 14. On the inner side of each connecting tube 34, there is provided a through hole 35, which passes through the lower member's main body 33. The contents dispensed from the stems 14 pass through the through holes 35. The lower member's main body 33 is also provided, on the upper side thereof, with a lower annular wall 36, which surrounds the two though holes 35, and a pair of lower partition walls 37, which is positioned between the two through holes 35. Furthermore, as illustrated in FIG. 1, the lower member's main body 33 is provided, on both outer ends on both sides thereof, with lower tab portions (first tab portions) 38, which extend downward. Each lower tab portion 38 has an outer surface provided with projections 38*a*, against which fingers may be placed.

Figure 5:
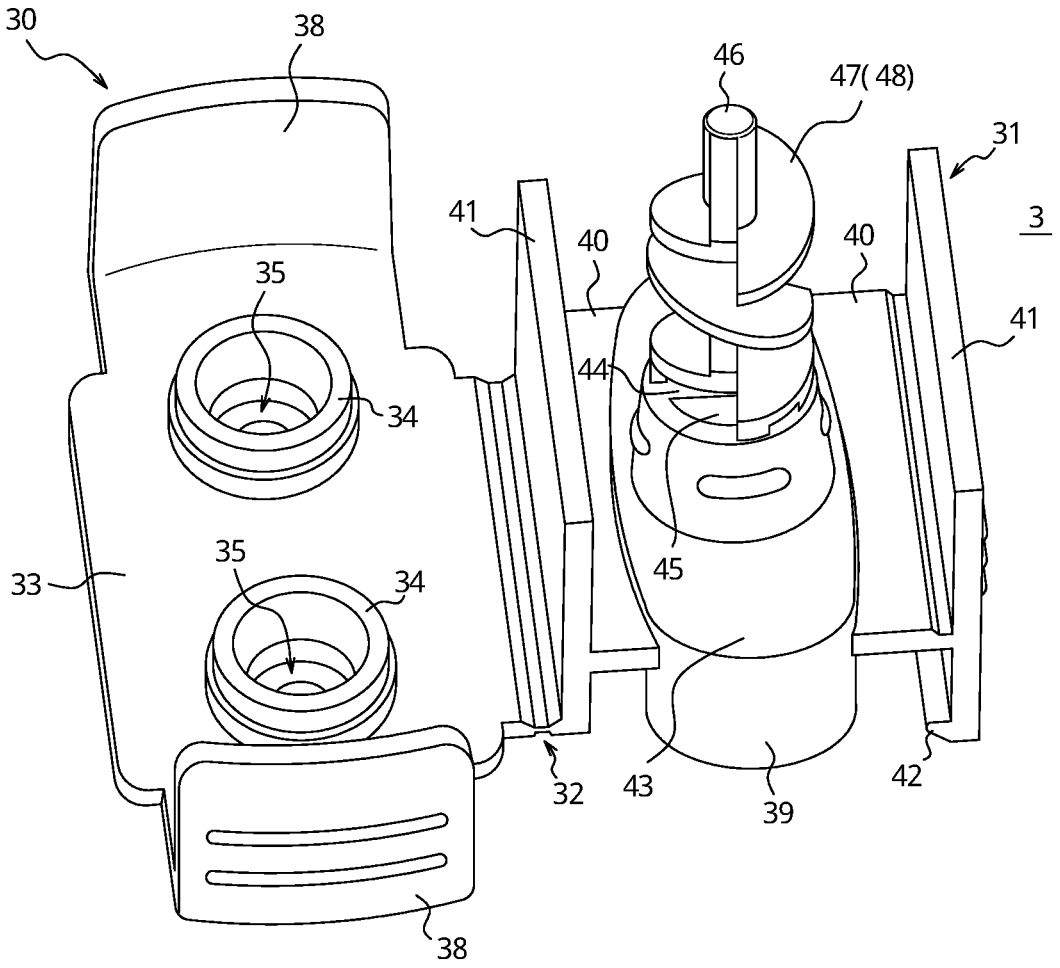
FIG. 5 is a perspective view of a coupling member in an opened state.

The upper member 31 includes an upper annular wall 39, which abuts against the lower annular wall 36 in a liquid-tight manner. The upper annular wall 39 has an outer circumferential surface, which is provided with a pair of support walls 40, which extend to the outer side (refer to FIGS. 2 and 5). On outer ends of the support walls 40, there are also provided upper tab portions (second tab portions) 41, which extend vertically with respect to the support walls 40. Herein, one of the upper tab portions 41 has a lower end, in which the aforementioned hinge 32 is provided. The other one of the upper tab portions 41 has a lower end, in which a claw portion 42 is provided. The claw portion 42 is configured to engage with the lower member's main body 33 when the coupling member 3 is in the closed state. The other one of the upper tab portions 41 is also provided, on the upper side thereof, with projections 41*a*, against which fingers may be placed.

The upper annular wall 39 is also provided, in an upper end thereof, with a ceiling wall 43, which has a middle portion protruding upward in the shape of a cylinder. As illustrated in FIG. 1, on the inner side of the ceiling wall 43, an upper partition wall 44 is provided. The upper partition wall 44 is configured to fit in between the pair of lower partition walls 37. On the upper side of the ceiling wall 43, a total of two holes (coupling holes) 45 are provided. The coupling holes 45 are disposed on both sides of the upper partition wall 44 and extend through the ceiling wall 43 (refer to FIGS. 1 and 5). When the coupling member 3 is in the closed state, passages for the contents are defined between the lower member 30 and the upper member 31. The contents from the two stems 14 flow from the through holes 35 to the coupling holes 45 separately along the passages.

The ceiling wall 43 is also provided with a rod-like portion 46, which extends upward from between the coupling holes 45. The rod-like portion 46 has an outer circumferential surface provided with a flange portion 48, which is configured by a plurality of semi-circular pieces 47.

As illustrated in FIG. 1, the cover 4 includes a cylindrical inner tubular portion 50, which is configured to surround the rod-like portion 46, the flange portion 48, and the two coupling holes 45 and to abut against the ceiling wall 43 in a liquid-tight manner. That is to say, after passing through the two coupling holes 45 separately, the two types of contents flow through the inner tubular portion 50 while being swirled by the flange portion 48. This promotes mixture of the contents.

The inner tubular portion 50 is provided, in an upper end thereof, with a top wall 51, which extends to the outer side. The top wall 51 is provided with a cover's annular wall 52, which extends upward. The top wall 51 is also provided, in a middle portion thereof, with a cover's through hole 53, which communicates with the inside of the inner tubular portion 50. On an outer end of the top wall 51, the cover 4 also includes an outer tubular portion 54. The outer tubular portion 54 extends downward to surround the inner tubular portion 50 and to cover the mounting cup 11. The outer tubular portion 54 is also configured to fit in between the side wall 22 and the outer circumferential wall 26, which are included in the fixed platen 2 (refer to FIG. 1). The outer tubular portion 54 is provided with at least one cut-out portion 55, which is formed by cutting part of the outer tubular portion 54 upward from the lower side thereof. The at least one cut-out portion 55 is configured to receive the lower tab portions 38. In the present embodiment, the pair of cut-out portions 55 is disposed to sandwich the mounting cup 11. The lower tab portions 38 and the cut-out portions 55 in the present embodiment are covered by the outer circumferential wall 26, and this contributes to better appearance.

As illustrated in FIG. 2, the outer tubular portion 54 includes a pair of operation pieces 56, which expand to the outer side in the radial direction and then extend downward. Each operation piece 56 has an inner surface provided with an inclined portion 57. The operation piece 56 herein is configured so that the inclined portion 57 abuts against a lower end of the outer circumferential wall 26 when the operation piece 56 is pressed from the outside. When the operation pieces 56 are pressed from the outside, the cover 4 is displaced downward along the inclined portions 57. Accordingly, the coupling member 3 and the two stems 14 are displaced downward.

The application member 5 includes a dome-like wall 60, which is configured to be disposed above the top wall 51 and to be fitted to and held by the application member 5. The dome-like wall 60 is provided, on a lower surface thereof, with an application member's annular wall 61, which is configured to abut against the cover's annular wall 52 in a liquid tight manner. The dome-like wall 60 is provided, in a middle portion thereof, with a dispensing port 62, through which the contents, after passing through the cover's through hole 53, are dispensed to the outside. The dispensing port 62 in the present embodiment is formed in the shape of a slit. The dome-like wall 60 is also provided with a comb portion 63, which is used to apply the contents dispensed from the dispensing port 62 to a subject, such as hair, while combing the subject.

To dispense the contents from the aerosol container 6 by using the dispenser 1 configured as above, the operation pieces 56 illustrated in FIG. 2 need to be pressed from the outside. Consequently, the cover 4, together with the coupling member 3 and the two stems 14, is displaced downward. As illustrated in FIG. 1, in the present embodiment, the outer tubular portion 54 of the cover 4 is configured to fit in between the side wall 22 and the outer circumferential wall 26, which are included in the fixed platen 2. The outer tubular portion 54 therefore serves to guide the cover 4 to be displaced straight downward during the downward displacement of the cover 4. Then, the two types of contents, which are dispensed from the downwardly displaced stems 14, pass through the through holes 35 and the coupling holes 45, flow through the inner tubular portion 50 while being swirled by the flange portion 48, and are dispensed from the dispensing port 62 via the cover's through hole 53. Subsequently, by moving the aerosol container 6 with the comb portion 63 being pressed against hair or the like, the contents may be applied while hair or the like is combed.

Figure 6:
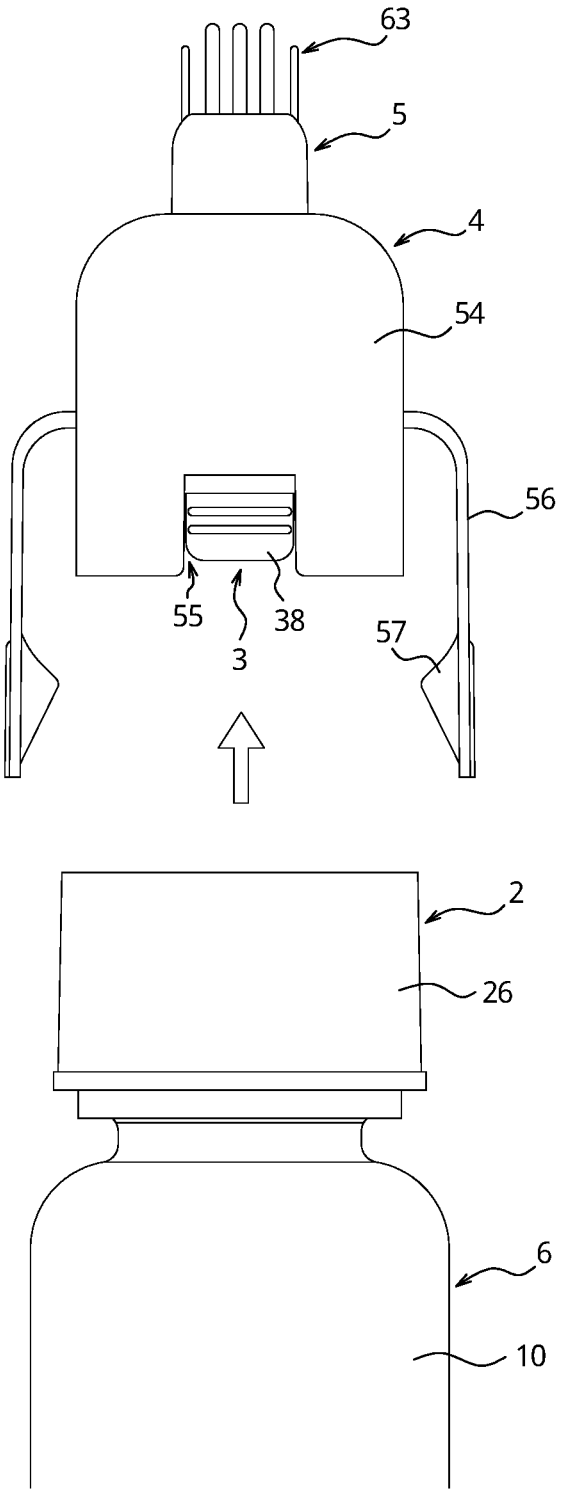
FIG. 6 is a side view of the state in which a cover illustrated in FIG. 2 is removed from a fixed platen.

To clean the coupling member 3, the cover 4 needs to be pulled upward with respect to the aerosol container 6 as illustrated in FIG. 6. Consequently, the cover 4 may be removed while the fixed platen 2 remains on the aerosol container 6.

Figure 7:
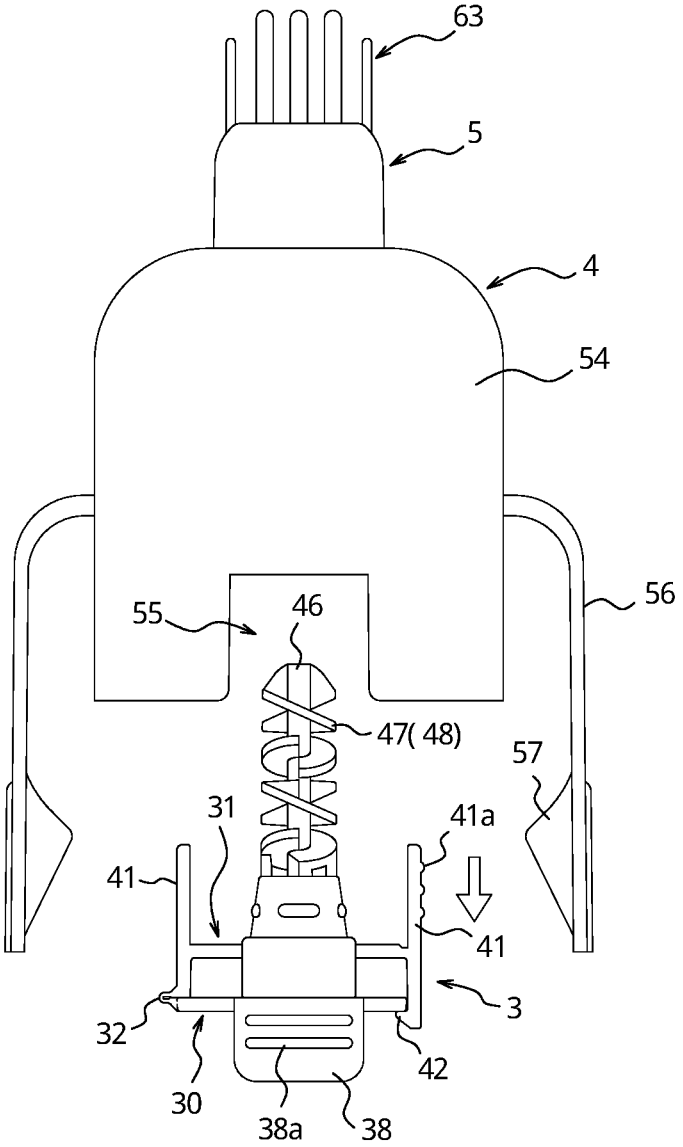
FIG. 7 is a side view of the state in which a connecting member is removed from a cover.

Since the pair of cut-out portions 55, which is provided in the outer tubular portion 54, receives the lower tab portions 38 of the coupling member 3, the cover 4 may be grasped by fingers of one hand, and the coupling member 3 may be grasped by pinching the lower tab portions 38 with fingers of the other hand. Then, by bringing both the hands away from each other, the coupling member 3 may be removed from the cover 4 as illustrated in FIG. 7. At this time, the contents pooled in the inner tubular portion 50 of the cover 4 are scraped by the flange portion 48 of the coupling member 3. This makes it easier to clean the inner tubular portion 50.

After the removal, by grasping the pair of lower tab portions 38, which is provided in the lower member 30, by pinching them with fingers of one hand and by grasping the pair of upper tab portions 41, which is provided in the upper member 31, by pinching the upper sides thereof, the claw portion 42 is disengaged from the lower member's main body 33. In this way, the coupling member 3 may be brought into the opened state as illustrated in FIG. 4. Consequently, the inside of the coupling member 3 is ready for the cleaning. Additionally, the projections 38*a*, which are provided in the lower tab portions 38, and the projections 41*a*, which are provided in the upper tab portions 41, serve as projections against which fingers may be placed. These projections prevent slippage when the coupling member 3 is removed from the cover 4 or when the coupling member 3 is opened.

Although the configuration and advantageous effects of the present disclosure have been described above, the dispenser for an aerosol container according to the present disclosure is not limited to the above embodiment, and various changes may be made within the scope of the claims. For example, although in the above embodiment the comb portion 63 extends upward, the comb portion 63 may extend obliquely with respect to the aerosol container 6 by attaching the application member 5 obliquely with respect to the cover 4. Furthermore, although in the above embodiment the cover 4 and the application member 5 are configured as separate members, they may be coupled integrally. Moreover, although in the above embodiment the cover 4 is displaced downward via the operation pieces 56, the operation pieces 56 may be omitted. In this case, the cover 4 may be displaced downward directly. Moreover, the rod-like portion 46 and the flange portion 48 do not necessarily need to be provided in the coupling member 3.

REFERENCE SIGNS LIST

1: Dispenser for aerosol container (dispenser)
2: Fixed platen
3: Coupling member
4: Cover
5: Application member
6: Aerosol container
10: Container main body
11: Mounting cup
12: Annular portion
13: Mounting cup's main body portion
14: Stem
20: Opening
21: Upper wall
22: Side wall
23: Rib
24: Flange
25: Fitting wall
26: Outer circumferential wall
30: Lower member
31: Upper member
32: Hinge
33: Lower member's main body
34: Connecting tube
35: Through hole
36: Lower annular wall
37: Lower partition wall
38: Lower tab portion (first tab portion)
38*a*: Projection
39: Upper annular wall
40: Support wall
41: Upper tab portion (second tab portion)
41*a*: Projection
42: Claw portion
43: Ceiling wall
44: Upper partition wall
45: Coupling hole
46: Rod-like portion
47: Semi-circular piece
48: Flange portion
50: Inner tubular portion
51: Top wall
52: Cover's annular wall
53: Cover's through hole
54: Outer tubular portion
55: Cut-out portion
56: Operation piece
57: Inclined portion
60: Dome-like wall
61: Application member's annular wall
62: Dispensing port
63: Comb portion

The invention claimed is:

1. A dispenser for an aerosol container, the dispenser comprising:

a fixed platen configured to be fitted to a mounting cup of the aerosol container, the mounting cup having two openings to accommodate two valve stems of the aerosol container;

a coupling member provided with two coupling holes through which contents dispensed from the two valve stems pass separately;

a cover that includes (i) an inner tubular portion configured to surround the two coupling holes and to define passages for the contents and (ii) an outer tubular portion configured to surround the coupling member; and an application member including a dispensing port through which the contents are dispensed from the inner tubular portion to outside, wherein:

the cover includes at least one cut-out portion in the outer tubular portion, and the coupling member includes at least one first tab portion configured to be accommodated in the at least one cut-out portion.

2. The dispenser according to claim 1, wherein:

the at least one cut-out portion comprises a cut-out portion located at each of two ends of the mounting cup, and the at least one first tab portion comprises two first tab portions disposed in correspondence with the two cut-out portions.

3. The dispenser according to claim 2, wherein the fixed platen includes an outer circumferential wall configured to surround the at least one cut-out portion and the at least one first tab portion.

4. The dispenser according to claim 3, wherein the coupling member further includes:

a lower member including the at least one first tab portion and two connecting tubes configured to be coupled to the two valve stems;

an upper member including at least one second tab portion, a rod-like portion, and the two coupling holes; and a hinge connecting the lower member and the upper member in an openable and closable manner.

5. The dispenser according to claim 2, wherein the coupling member further includes:

(i) a lower member including the at least one first tab portion and two connecting tubes configured to be coupled to the two valve stems;

(ii) an upper member including at least one second tab portion, a rod-like portion, and the two coupling holes; and (iii) a hinge connecting the lower member and the upper member in an openable and closable manner.

6. The dispenser according to claim 1, wherein the fixed platen includes an outer circumferential wall configured to surround the at least one cut-out portion and the at least one first tab portion.

7. The dispenser according to claim 6, wherein the coupling member further includes:

a lower member including the at least one first tab portion and two connecting tubes configured to be coupled to the two valve stems;

an upper member including at least one second tab portion, a rod-like portion, and the two coupling holes; and a hinge connecting the lower member and the upper member in an openable and closable manner.

8. The dispenser according to claim 1, wherein the coupling member further includes:

(i) a lower member including the at least one first tab portion and two connecting tubes configured to be coupled to the two valve stems;

(ii) an upper member including at least one second tab portion, a rod-like portion, and the two coupling holes; and (iii) a hinge connecting the lower member and the upper member in an openable and closable manner.

* * * * *